US007189055B2

(12) United States Patent
Marini et al.

(10) Patent No.: US 7,189,055 B2
(45) Date of Patent: Mar. 13, 2007

(54) COVERPLATE DEFLECTORS FOR REDIRECTING A FLUID FLOW

(75) Inventors: Remo Marini, Montreal (CA); Sri Sreekanth, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 98 days.

(21) Appl. No.: 11/139,607

(22) Filed: May 31, 2005

(65) Prior Publication Data

US 2006/0269398 A1 Nov. 30, 2006

(51) Int. Cl.
*F01D 5/00* (2006.01)

(52) U.S. Cl. ..... 415/115; 415/116; 415/208.2

(58) Field of Classification Search ..... 416/95, 416/193 A, 219 R, 239, 248; 415/115, 116, 415/168.1, 168.2, 168.4, 208.1, 208.2, 208.5
See application file for complete search history.

(56) References Cited

U.S. PATENT DOCUMENTS

| | | | |
|---|---|---|---|
| 2,406,499 | A | 8/1946 | Jandasek |
| 2,650,752 | A | 9/1953 | Hoadley |
| 2,735,612 | A | 2/1956 | Hausmann |
| 2,920,864 | A | 1/1960 | Lee |
| 2,951,340 | A | 9/1960 | Howald |
| 2,988,325 | A | 6/1961 | Dawson |
| 2,990,107 | A | 6/1961 | Edwards |
| 3,039,736 | A | 6/1962 | Pon |
| 3,193,185 | A | 7/1965 | Erwin et al. |
| 3,481,531 | A | 12/1969 | MacArthur et al. |
| 3,578,264 | A | 5/1971 | Kuethe |
| 3,602,605 | A | 8/1971 | Lee et al. |
| 3,768,921 | A | 10/1973 | Brown et al. |
| 3,936,215 | A | 2/1976 | Hoff |
| 3,990,812 | A | 11/1976 | Radtke |
| 4,076,454 | A | 2/1978 | Wennerstrom |
| 4,135,857 | A | 1/1979 | Pannone et al. |
| 4,222,703 | A | 9/1980 | Schaum et al. |
| 4,348,157 | A | 9/1982 | Campbell et al. |
| 4,420,288 | A | 12/1983 | Bischoff |
| 4,590,759 | A | 5/1986 | Blizzard |
| 4,624,104 | A | 11/1986 | Stroem |
| 4,640,091 | A | 2/1987 | Blizzard |
| 4,674,955 | A | 6/1987 | Howe et al. |
| 4,708,588 | A | 11/1987 | Schwarz et al. |
| 4,712,980 | A | 12/1987 | Gely et al. |
| 4,720,235 | A | 1/1988 | Lachance et al. |
| 4,844,695 | A | 7/1989 | Banks et al. |
| 5,211,533 | A | 5/1993 | Walker et al. |
| 5,215,439 | A | 6/1993 | Jansen et al. |
| 5,230,603 | A | 7/1993 | Day |
| 5,846,055 | A | 12/1998 | Brodersen et al. |
| 6,077,035 | A | 6/2000 | Walters et al. |
| 6,413,045 | B1 | 7/2002 | Dancer et al. |
| 6,595,741 | B2 | 7/2003 | Briesenick et al. |
| 6,672,832 | B2 | 1/2004 | Leeke et al. |
| 2004/0265118 | A1* | 12/2004 | Naik et al. ..... 415/116 |

* cited by examiner

*Primary Examiner*—Richard A. Edgar
(74) *Attorney, Agent, or Firm*—Ogilvy Renault LLP

(57) ABSTRACT

A deflector arrangement is provided for improving turbine efficiency by imparting added tangential velocity to a leakage flow entering the working fluid flowpath of a gas turbine engine.

19 Claims, 6 Drawing Sheets

Fig. 4
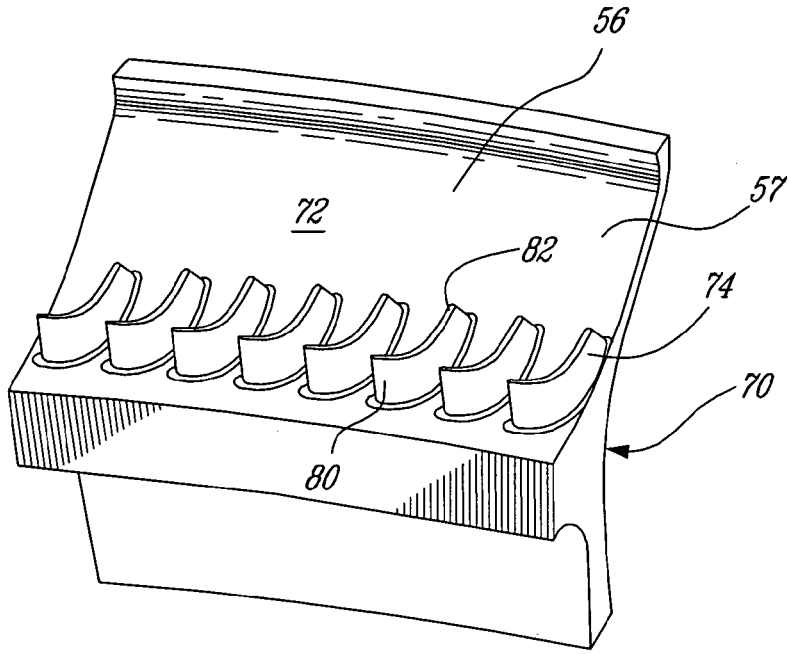
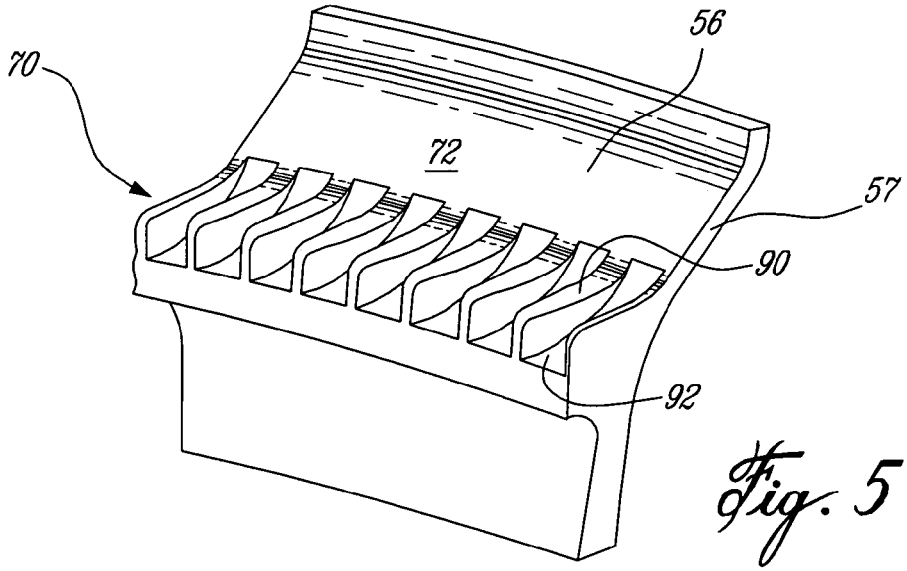
Fig. 5

COVERPLATE DEFLECTORS FOR REDIRECTING A FLUID FLOW

TECHNICAL FIELD

The invention relates generally to a deflector for redirecting a fluid flow in a leakage path and entering a gaspath of a gas turbine engine.

BACKGROUND OF THE ART

It is commonly known in the field of gas turbine engines to bleed cooling air derived from the compressor between components subjected to high circumferential and/or thermal forces in operation so as to purge hot gaspath air from the leakage path and to moderate the temperature of the adjacent components. The cooling air passes through the leakage path and is introduced into the main working fluid flowpath of the engine. Such is the case where the leakage path is between a stator and a rotor assembly. In fact, at high rotational speed, the rotor assembly propels the leakage air flow centrifugally much as an impeller.

Such air leakage into the working fluid flowpath of the engine is known to have a significant impact on turbine efficiency. Accordingly, there is a need for controlling leakage air into the working fluid flowpath of gas turbine engines.

SUMMARY OF THE INVENTION

It is therefore an object of this invention to provide a new fluid leakage deflector arrangement which addresses the above-mentioned issues.

In one aspect, the present invention provides a rotor assembly of a gas turbine engine having a working fluid flow path and a leakage path leading to the working fluid flowpath adjacent the rotor assembly, the rotor assembly comprising: a rotor disc carrying a plurality of circumferentially distributed blades, the blades being adapted to extend radially outwardly into the working fluid flowpath, a coverplate forwadly mounted relative to the rotor disc, and an array of deflectors circumferentially distributed on a front face of the coverplate for imparting a tangential velocity component to a flow of leakage fluid flowing through the leakage path, each pair of adjacent deflectors defining an inter-deflector passage through which the leakage fluid flows before being discharged into the working fluid flowpath.

In another aspect, the present invention provides a coverplate for a rotor disc of a gas turbine engine having a gaspath in fluid flow communication with a fluid leakage path, the coverplate being adapted to extend axially forward from the rotor disc adjacent to the fluid leakage path, the coverplate comprising an array of deflectors circumferentially distributed on a front face of the coverplate, the array of deflectors having a first end and a second end, the first end pointing in the direction of a fluid flow in the fluid leakage path, and a concave guiding surface extending from said first end to said second end.

Further details of these and other aspects of the present invention will be apparent from the detailed description and figures included below.

DESCRIPTION OF THE DRAWINGS

Reference is now made to the accompanying figures depicting aspects of the present invention, in which:

FIG. 4 is a fragmented perspective view of an array of deflectors distributed on the front face of the coverplate in the form of winglets;

FIG. 5 is a fragmented perspective view of an array of deflectors distributed on the front face of the coverplate in the form of lands between adjacent grooves;

DETAILED DESCRIPTION OF THE PREFERRED EMBODIMENTS

Figure 1:
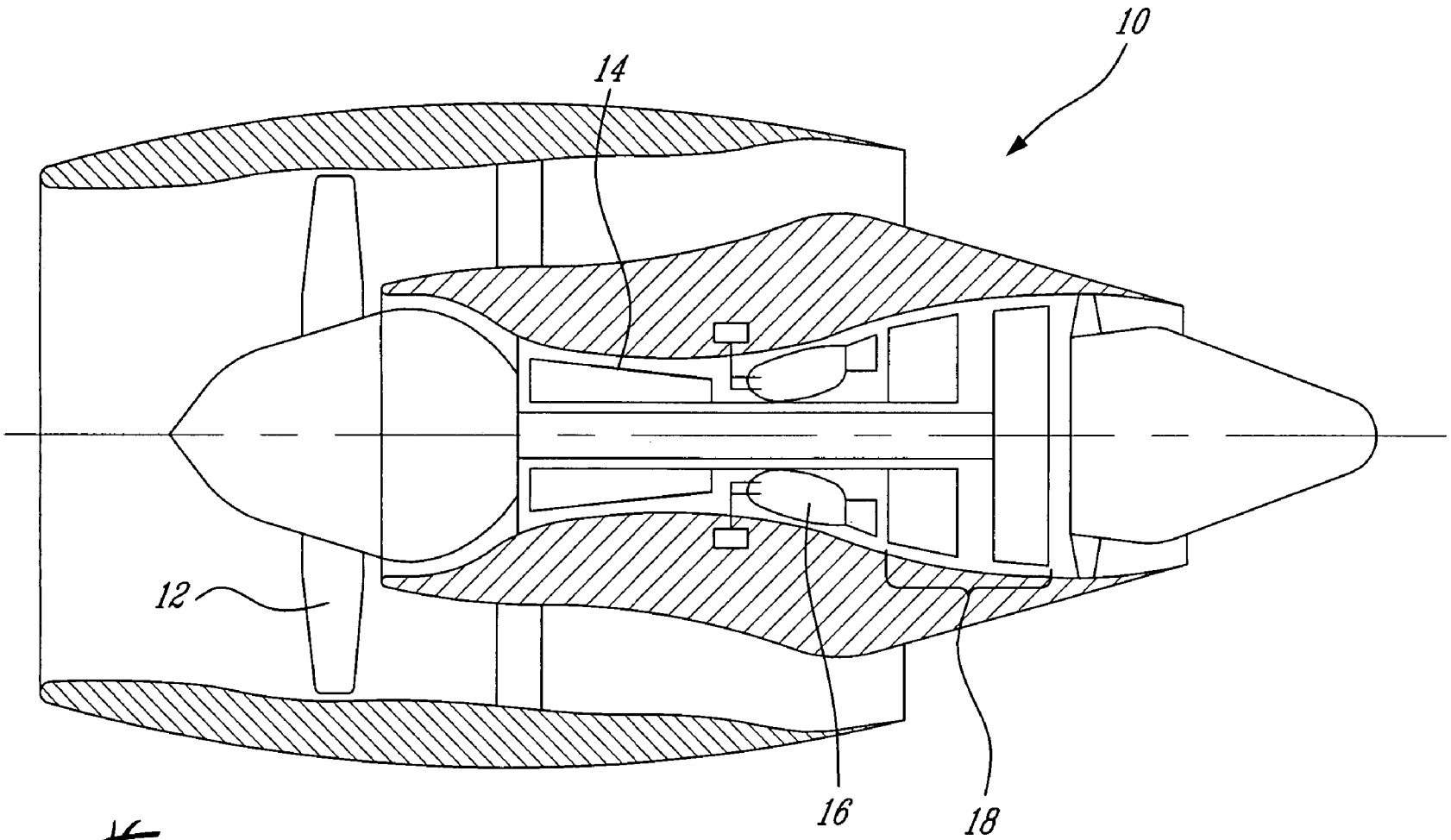
FIG. 1 is a schematic cross-sectional view of a gas turbine engine.

FIG. 1 illustrates a gas turbine engine 10 of a type preferably provided for use in subsonic flight, generally comprising in serial flow communication through a working flow path a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
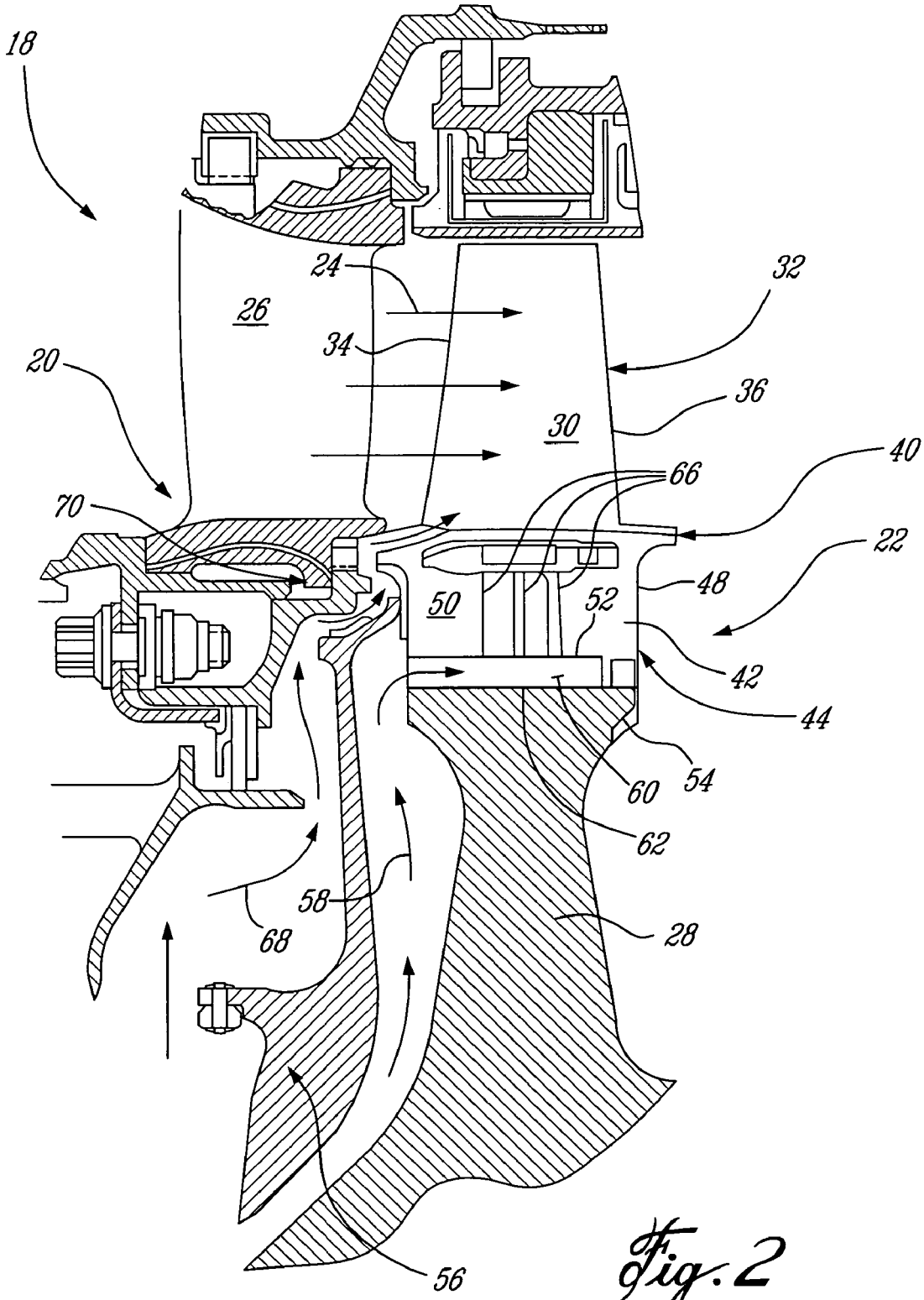
FIG. 2 is an axial cross-sectional view of a portion of a turbine section of the gas turbine engine showing a coverplate mounted on a rotor disc including a deflector arrangement in accordance with an embodiment of the present invention.

FIG. 2 illustrates in further detail the turbine section 18 which comprises among others a forward stator assembly 20 and a rotor assembly 22. A gaspath indicated by arrows 24 for directing the stream of hot combustion gases axially in an annular flow is generally defined by the stator and rotor assemblies 20 and 22 respectively. The stator assembly 20 directs the combustion gases towards the rotor assembly 22 by a plurality of nozzle vanes 26, one of which is depicted in FIG. 2. The rotor assembly 22 includes a disc 28 drivingly mounted to the engine shaft (not shown) linking the turbine section 18 to the compressor 14. The disc 28 carries at its periphery a plurality of circumferentially distributed blades 30 that extend radially outwardly into the annular gaspath 24, one of which is shown in FIG. 2.

Figure 3:
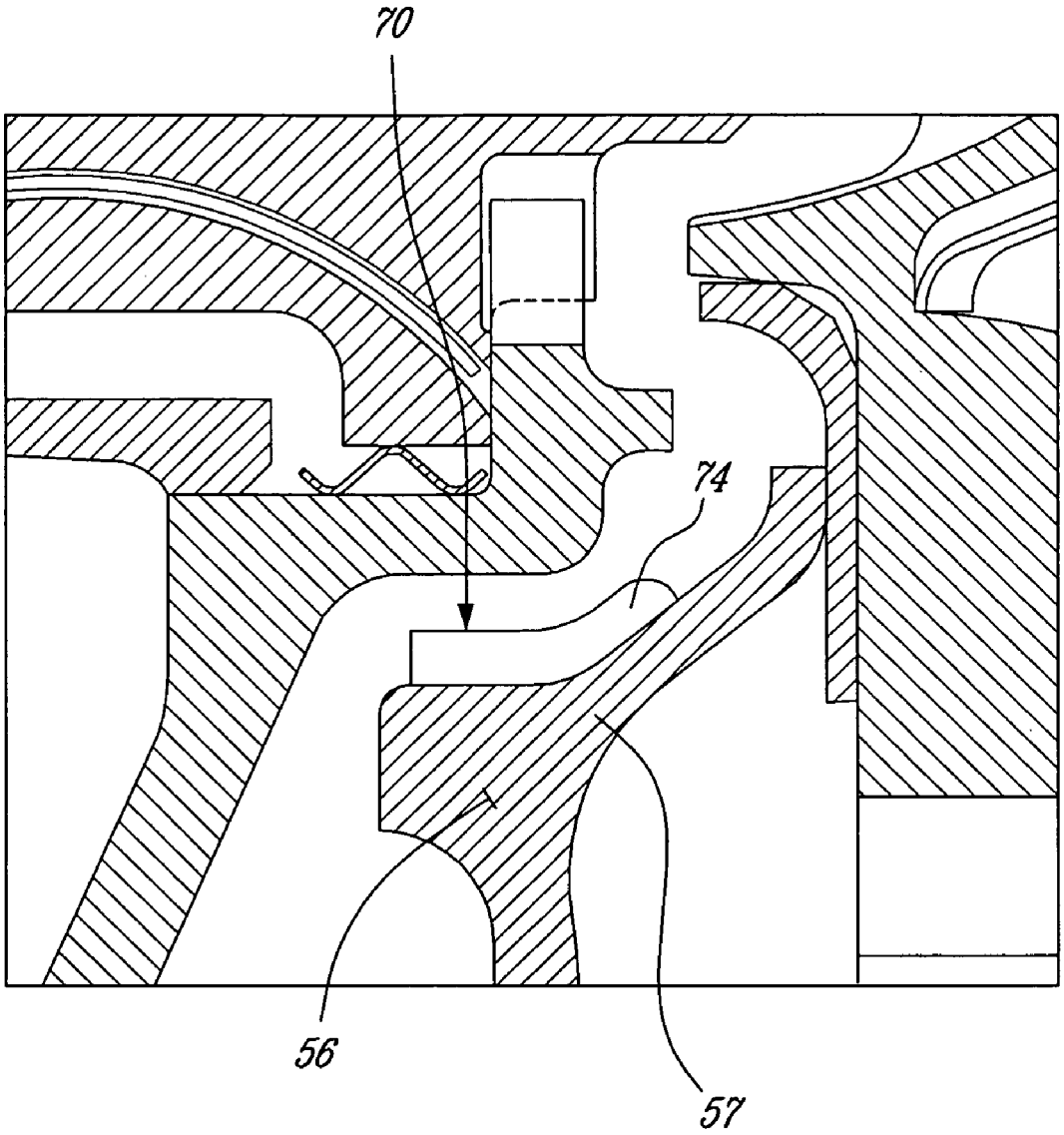
FIG. 3 is an axial cross-section view of a deflector provided on a front face of the coverplate.

Referring concurrently to FIGS. 2 and 3, it can be seen that each blade 30 has an airfoil portion 32 having a leading edge 34, a trailing edge 36 and a tip 38. The airfoil portion 32 extends from a platform 40 provided at the upper end of a root portion 42. The root portion 42 is captively received in a complementary blade attachment slot 44 (FIG. 2) defined in the outer periphery of the disc 28. The root portion 42 is defined by front and rear surfaces 46 and 48, two side faces 50 and an underface 52, and is typically formed in a fir tree configuration that cooperates with mating serrations in the blade attachment slot 44 to resist centrifugal dislodgement of the blade 30. A rearward circumferential shoulder 54 adjacent the rearward surface of the root 42 is used to secure the blades 30 to the rotor disc 28.

Thus, the combustion gases enter the turbine section 18 in a generally axial downstream direction and are redirected at the trailing edges of the vanes 26 at an oblique angle toward the leading edges 34 of the rotating turbine blades 30.

Referring to FIG. 2, the turbine section 18, and more particularly the rotor assembly 22 is cooled by air bled from the compressor 14 (or any other source of coolant). The rotor disc 28 has a forwardly mounted coverplate 56 that covers almost the entire forward surface thereof except a narrow circular band about the radially outward extremity. The coverplate 56 directs the cooling air to flow radially outwards such that it is contained between the coverplate 56 and the rotor disc 28. The cooling air indicated by arrows 58 is directed into an axially extending (relative to the disc axis of rotation) blade cooling entry channel or cavity 60 defined by the undersurface 52 of the root portion 42 and the bottom wall 62 of the slot 44. The channel 60 extends from an entrance opposing a downstream end closed by a rear tab 64. The channel 60 is in fluid flow communication with a blade internal cooling flow path (not shown) including a plurality of axially spaced-apart cooling air passages 66 extending from the root 42 to the tip 38 of the blade 30. The passages 66 lead to a series of orifices (not shown) in the trailing edge 36 of the blade 30 which reintroduce and disperse the cooling air flow into the hot combustion gas flow of the gaspath 24.

Still referring to FIG. 2, a controlled amount of fluid from the cooling air is permitted to re-enter the gaspath 24 via a labyrinth leakage path identified by arrows 68. The leakage path 68 is defined between the forward stator assembly 20 and the rotor assembly 22. More particularly, the fluid progresses through the leakage path until introduced into the gaspath 24 such that it comes into contact with parts of the stator assembly 20, the forward surface of the coverplate 56, the rotor disc 28, the front face 46 of the root 42 and the blade platform 40. The fluid flows through the labyrinth leakage path 68 to purge hot combustion gases that may have migrated into the area between the stator and rotor assemblies 20 and 22 which are detrimental to the cooling system. Thus, the leakage fluid creates a seal that prevents the entry of the combustion gases from the gaspath 24 into the leakage path 68. A secondary function of the fluid flowing through the leakage path 68 is to moderate the temperature of adjacent components.

In a preferred embodiment of the present invention, the rotor assembly 22 comprises a deflector arrangement 70 circumferentially distributed on the front face 72 of the coverplate 56 as shown in FIGS. 3 to 6. The deflector arrangement 70 is provided as an array of equidistantly spaced deflectors in series with respect to each other such that they are in side-by-side circumferential relation. The deflector arrangement 70 is exposed to the flow of leakage fluid in the leakage path 68 and defines a number of discrete inter-deflector passages through which the leakage fluid flows before being discharged into the working fluid flow-path or gaspath 24. The deflectors 70 may be positioned in a multitude of orientations and positions on the coverplate 56. It is preferable that the deflectors be disposed proximal the periphery of the coverplate 56 such that they are immersed within the leakage path 68. A preferred location for the starting point of the array of deflectors is on the hammer head 57 feature of the coverplate such that a shrouded passage is formed between the coverplate hammer head 57 and the stator assembly. The deflector arrangement 70 is provided on the front face of the coverplate 56 for directing the flow of leakage air to merge smoothly with the flow of hot gaspath air causing minimal disturbance. The deflector arrangement 70 is designed in accordance with the rotational speed of the rotor assembly 22 and the expected fluid flow velocity passing adjacent the coverplate 56 via the leakage path 68.

FIG. 3 illustrates a preferred embodiment of the deflector arrangement 70 extending at an incline angle with respect to the axis of rotation of the rotor disc 28. In another embodiment, the deflector arrangement 70 may extend in a plane perpendicular to the axis of rotation, or in still another embodiment, the deflector arrangement 70 may extend in a plane parallel to the axis of rotation. The embodiment illustrated in FIG. 3 has hybrid deflectors with axial and radial features. However, it is understood that the deflectors could also be provided only on either one of an axially or a radially extending surface of the coverplate 56. It should be understood that still other embodiments exist without departing from the scope or nature of the present invention.

In the exemplary embodiment of FIGS. 3 and 4, the array of deflectors 70 are provided as aerodynamically shaped winglets 74 extending axially and radially from the front face of the coverplate 56. The array of winglets 74 may be integral to the coverplate 56 or mounted thereon. Preferably, the array of winglets 78 are identical in shape and size, as will be discussed in detail furtheron.

Figure 6:
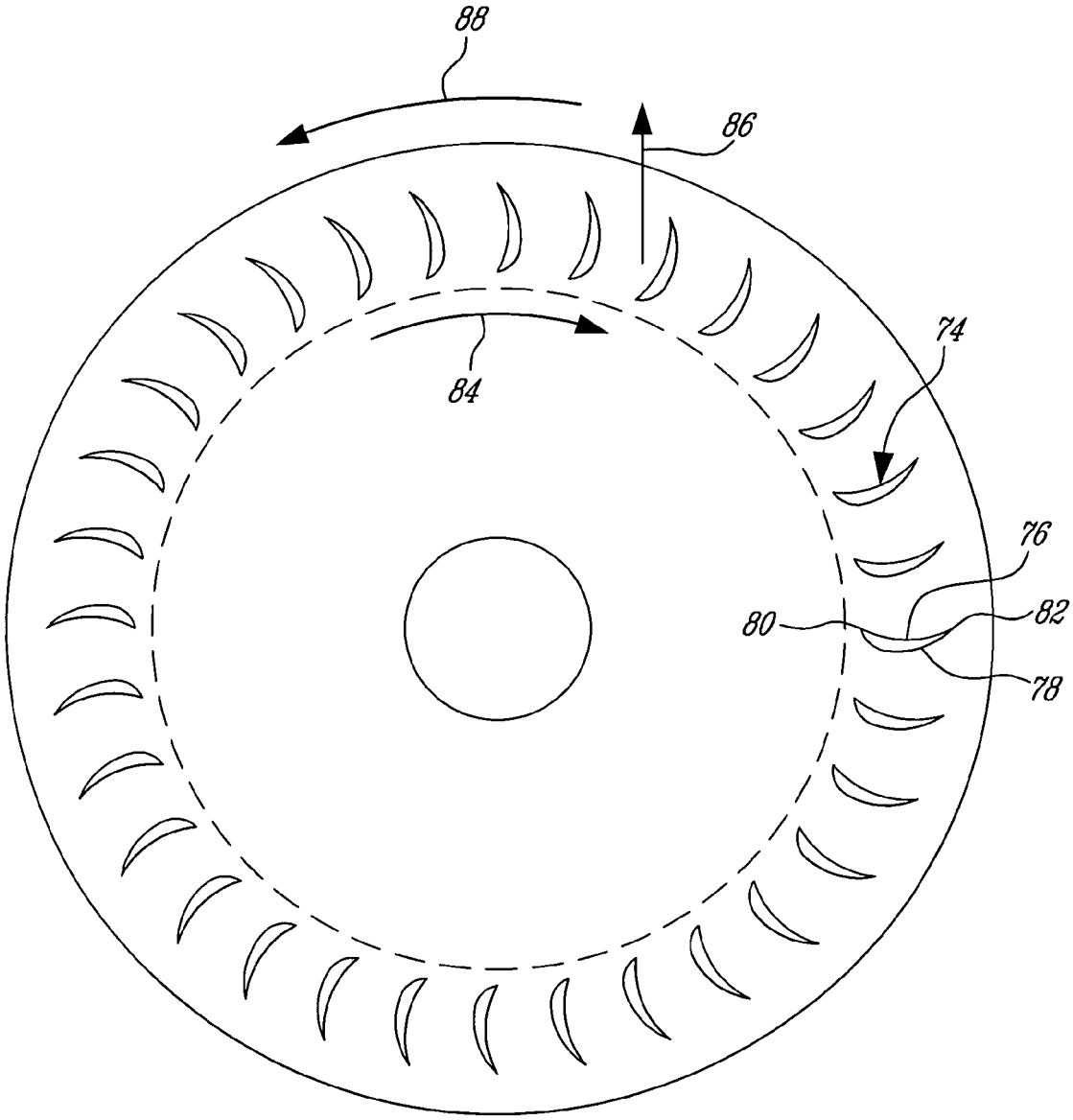
FIG. 6 is a front plan schematic view of an array of deflectors circumferentially distributed on the front face of the coverplate.

Referring concurrently to FIGS. 4 to 6, each deflector of the deflector arrangement 70 has a concave side 76 and a convex side 78 defining a "J" shape profile. Another possible shape for the deflectors is defined by a reverse "C" shape profile. Each deflector 70 extends radially outwardly between a first end or a leading edge 80 and a second end or a trailing edge 82 thereof. The concave sides 76 of the deflector arrangement 70 are oriented to face the oncoming flow of leakage fluid in the leakage path 68, the direction of which is indicated by arrow 84 in FIG. 6. Each deflector 70 has a curved entry portion curving away from the direction of oncoming flow of leakage fluid and merging with a generally straight exit portion. The deflectors 70 are thus configured to turn the oncoming flow of leakage fluid from a first direction indicated by arrow 84 to a second direction indicated by arrow 86 substantially tangential to the flow of combustion gases flowing over turbine blades 30.

Figure 7:
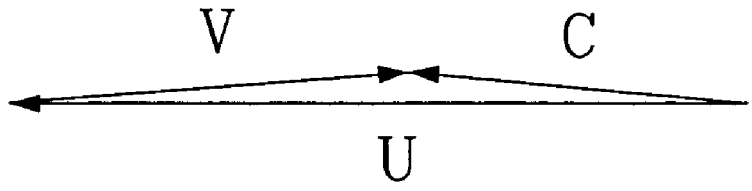
FIG. 7 is a velocity triangle representing the original velocity of a fluid flow exiting a leakage path before being scooped and redirected by a deflector.
Figure 8:
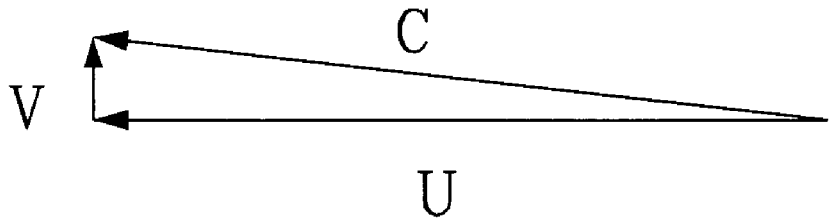
FIGS. 8 and 9 are possible velocity triangles representing the resulting velocity of the fluid flow when scooped and redirected by a deflector.
Figure 9:
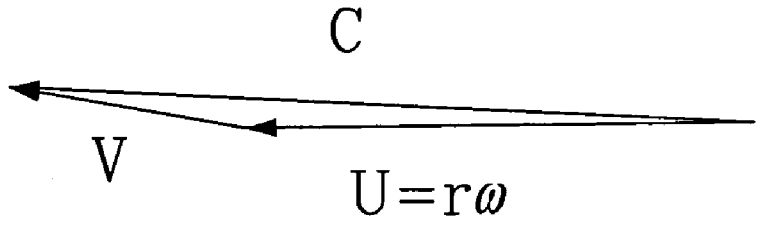

FIG. 7 represents the inlet velocity triangle of the deflectors while FIGS. 8 and 9 represent possible exit velocity triangles of the deflectors. The arrow 84 of FIG. 6 represents vector V of FIG. 7 and the arrow 86 of FIG. 6 represents vector V of FIGS. 8 and 9. Vector V indicates the relative velocity of the fluid flow in the leakage path 68. The relative velocity vector V is defined as being relative to the rotating rotor assembly 22, and more particularly relative to the direction and magnitude of the coverplate 56 rotation indicated by vector U and represented by arrow 88 in FIG. 6. The absolute velocity of the fluid flow is indicated by vector C and is defined as being relative to a stationary observer. It can be observed from FIG. 7 that the absolute velocity C of the fluid flow in the leakage path 68 is less in magnitude than the magnitude of the velocity U of blade rotation at the same point. In order to have the absolute fluid flow velocity C substantially equal or greater than the blade rotation velocity U as illustrated in FIGS. 8 and 9, the deflectors 70 are used to scoop the fluid flow and re-direct the flow in a substantially perpendicular or inclined direction to the direction of blade rotation. Thus an observer would see the leakage fluid flowing at substantially the same or greater speed as the coverplate 56 rotates at the location point of the deflectors 70.

More specifically, the leading edges 80 of the deflectors 70 are pointed in a direction substantially opposite the direction of arrow 84 and in the direction of rotation of the rotor assembly 22 to produce a scooping effect thereby imparting a velocity to the cooling air leakage flow that is tangential to the gaspath flow. Test data indicates that imparting tangential velocity to the leakage air significantly reduces the impact on turbine efficiency. In fact, the scooping effect of the deflectors 70 also causes an increase in fluid momentum which gives rise to the increase in actual magnitude of the fluid flow. The fluid emerges from the deflectors 70 with an increased momentum that better matches the high momentum of the gaspath flow and with a relative direction that substantially matches that of the coverplate as indicated by arrow 88 of FIG. 6. As a result, the fluid flow merges with the hot gaspath flow in a more optimal aerodynamic manner thereby reducing inefficiencies caused by colliding air flows. Such improved fluid flow control is advantageous in improving turbine performance.

Now referring to FIG. 5, an alternative exemplary embodiment of the array of deflectors 70 is shown. The array of deflectors 70 is provided as aerodynamically shaped lands 90 between adjacent grooves 92 defined on the coverplate. Similar to the winglets 78, the array of lands 90 and grooves 92 is provided circumferentially on the front face 72 of the coverplate 56 extending axially, radially or as a hybrid feature, i.e. axially and radially, thereon. It is preferable that the grooves 92 be integrally formed within the coverplate 56 such as by machining or casting. Notably, the lands 90 and grooves 92 are preferably identical in shape, size, depth and length. The proximity between the lands 90 may vary depending on the velocity of the leakage air and the rotational velocity of the coverplate 56.

The above description is meant to be exemplary only, and one skilled in the art will recognize that changes may be made to the embodiments described without department from the scope of the invention disclosed. For example, the deflector arrangement may be provided in various shapes and forms and is not limited to an array thereof while still imparting tangential velocity and increased momentum to the leakage air flow. The deflectors could be mounted at locations on the coverplate other than those embodied so long as they are exposed to the leakage air in such a way as to impart added tangential velocity thereto. Still other modifications which fall within the scope of the present invention will be apparent to those skilled in the art, in light of a review of this disclosure, and such modifications are intended to fall within the appended claims.

The invention claimed is:

1. A coverplate for a rotor disc of a gas turbine engine having a gaspath in fluid flow communication with a fluid leakage path, the coverplate being adapted to extend axially forward from the rotor disc adjacent to the fluid leakage path, the coverplate comprising an array of deflectors circumferentially distributed on a front face of the coverplate, the array of deflectors having a first end and a second end, the first end pointing in the direction of a fluid flow in the fluid leakage path, and a concave guiding surface extending from said first end to said second end.

2. The coverplate as defined in claim 1, wherein said first end points in a direction of rotation of said coverplate.

3. The coverplate as defined in claim 1, wherein each of said deflectors has a curved entry portion curving gradually away from the first end, said curved entry portion merging into a substantially radially extending exit portion.

4. The coverplate as defined in claim 1, wherein each of said deflectors has a curved entry portion curving gradually away from the first end, said curved entry portion merging into a substantially axially extending exit portion.

5. The coverplate as defined in claim 1, wherein each of said deflectors has a curved entry portion curving gradually away from the first end, said curved entry portion merging into a substantially hybrid exit portion with both radial and axial features.

6. The coverplate as defined in claim 1, wherein each of said deflectors has a curved entry portion curving gradually away from the first end, said curved entry portion merging into a substantially straight exit portion defining a "J" shape profile.

7. The coverplate as defined in claim 1, wherein each of said deflectors has a curved entry portion curving gradually away from the first end, said curved entry portion merging into a substantially straight exit portion defining a reverse "C" shape profile.

8. The coverplate as defined in claim 1, wherein said array of deflectors is provided as winglets extending axially outwards from the front face of the coverplate.

9. The coverplate as defined in claim 1, wherein an array of side-by-side circumferentially distributed grooves is defined on the front face of the coverplate, each pair of adjacent grooves being spaced by a land, the lands forming said deflectors.

10. A rotor assembly of a gas turbine engine having a working fluid flow path and a leakage path leading to the working fluid flowpath adjacent the rotor assembly, the rotor assembly comprising: a rotor disc carrying a plurality of circumferentially distributed blades, the blades being adapted to extend radially outwardly into the working fluid flowpath, a coverplate forwadly mounted relative to the rotor disc, and an array of deflectors circumferentially distributed on a front face of the coverplate for imparting a tangential velocity component to a flow of leakage fluid flowing through the leakage path, each pair of adjacent deflectors defining an inter-deflector passage through which the leakage fluid flows before being discharged into the working fluid flowpath.

11. The rotor assembly as defined in claim 1, wherein each of said deflectors has a leading end pointing into an oncoming flow of leakage fluid and a guiding surface redirecting the leakage fluid from a first direction to a second direction substantially tangential to a direction of the working fluid flowing through the working fluid flowpath.

12. The rotor assembly as defined in claim 10, wherein each of said deflectors has a leading end generally pointing in a direction of rotation of said rotor assembly.

13. The rotor assembly as defined in claim 12, wherein the deflectors have a trailing end extending away from the leading end defining a "J" shape profile.

14. The rotor assembly as defined in claim 13, wherein the array of deflectors is provided as winglets extending axially outwards from the front face of the coverplate.

15. The rotor assembly as defined in claim 13, wherein an array of side-by-side circumferentially distributed grooves is defined on the front face of the coverplate, each pair of adjacent grooves being spaced by a land, the lands forming said deflectors.

16. The rotor assembly as defined in claim 12, wherein the deflectors have a trailing end extending towards the leading end defining a reverse "C" shape profile.

17. The rotor assembly as defined in claim 10, wherein each of said deflectors has a curved entry portion curving gradually away from a flow direction of the leakage flow, said curved entry portion merging into a substantially radially extending exit portion.

18. The rotor assembly as defined in claim 10, wherein each of said deflectors has a curved entry portion curving gradually away from a flow direction of the leakage flow, said curved entry portion merging into a substantially axially extending exit portion.

19. The rotor assembly as defined in claim 10, wherein each of said deflectors has a curved entry portion curving gradually away from a flow direction of the leakage flow, said curved entry portion merging into a substantially hybrid exit portion with both radial and axial features.

* * * * *